US008474764B2

(12) United States Patent
Kieselstein et al.

(10) Patent No.: US 8,474,764 B2
(45) Date of Patent: Jul. 2, 2013

(54) LIGHTWEIGHT THREE-DIMENSIONAL WIRE STRUCTURE AND METHOD FOR THE PRODUCTION THEREOF

(76) Inventors: Stephan Kieselstein, Chemnitz (DE); Thomas Weinrich, Chemnitz (DE)

( * ) Notice: Subject to any disclaimer, the term of this patent is extended or adjusted under 35 U.S.C. 154(b) by 105 days.

(21) Appl. No.: 13/142,879

(22) PCT Filed: Dec. 29, 2009

(86) PCT No.: PCT/DE2009/001831

§ 371 (c)(1),
(2), (4) Date: Jun. 30, 2011

(87) PCT Pub. No.: WO2010/075853

PCT Pub. Date: Jul. 8, 2010

(65) Prior Publication Data

US 2011/0266400 A1 Nov. 3, 2011

(30) Foreign Application Priority Data

Dec. 30, 2008 (DE) ..... 10 2008 063 289

(51) Int. Cl.
*B21F 27/02* (2006.01)
*B21F 27/00* (2006.01)

(52) U.S. Cl.
USPC ..... 245/5; 245/2; 140/124

(58) Field of Classification Search
USPC ..... 245/1, 2, 4, 5, 6, 9; 140/92.6, 3 B, 140/103, 124
See application file for complete search history.

(56) References Cited

U.S. PATENT DOCUMENTS

| | | | | | |
|---|---|---|---|---|---|
| 1,444,491 | A * | 2/1923 | Baldwin | 273/350 |
| 3,139,959 | A * | 7/1964 | Kraft | 428/98 |
| 4,084,624 | A * | 4/1978 | Moineau | 140/80 |
| 4,271,628 | A * | 6/1981 | Barlow | 446/126 |
| 4,345,730 | A * | 8/1982 | Leuvelink | 245/6 |
| 4,423,543 | A * | 1/1984 | Leuvelink | 29/433 |
| 4,488,347 | A * | 12/1984 | Leuvelink | 29/433 |
| 4,603,519 | A * | 8/1986 | Lew et al. | 52/81.2 |
| 4,667,451 | A * | 5/1987 | Onoda | 52/646 |
| 4,711,057 | A * | 12/1987 | Lew et al. | 52/81.2 |
| 4,722,162 | A * | 2/1988 | Wilensky | 52/652.1 |
| 5,197,254 | A * | 3/1993 | Smith | 52/653.1 |
| 5,265,395 | A * | 11/1993 | Lalvani | 52/648.1 |
| 5,505,035 | A * | 4/1996 | Lalvani | 52/648.1 |
| 6,076,324 | A * | 6/2000 | Daily et al. | 52/648.1 |
| 6,170,560 | B1 * | 1/2001 | Daily et al. | 164/516 |
| 6,612,556 | B2 * | 9/2003 | Petrina | 267/168 |
| 6,684,912 | B2 * | 2/2004 | Katsura | 139/425 R |
| 8,042,312 | B2 * | 10/2011 | Kang et al. | 52/664 |
| 2001/0010140 | A1 * | 8/2001 | Ritter et al. | 52/649.1 |
| 2007/0095012 | A1 * | 5/2007 | Kang et al. | 52/750 |
| 2010/0071300 | A1 * | 3/2010 | Kang et al. | 52/646 |

FOREIGN PATENT DOCUMENTS

| | | |
|---|---|---|
| DE | 3238251 A1 | 4/1983 |
| DE | 19527618 A1 | 2/1997 |
| DE | 202004006662 U1 | 8/2004 |

(Continued)

*Primary Examiner* — Bobby Muromoto, Jr.
(74) *Attorney, Agent, or Firm* — Laurence A. Greenberg; Werner H. Stemer; Ralph E. Locher

(57) ABSTRACT

A lightweight three-dimensional wire structure which includes a plurality of wires that are connected to each other and intersect in the three-dimensional space to form a plurality of cells. In addition, a method for producing the three-dimensional wire structure.

12 Claims, 13 Drawing Sheets

FOREIGN PATENT DOCUMENTS

| | | | |
|---|---|---|---|
| DE | 11 2004 002 127 | B4 | 10/2008 |
| GB | 2108539 | A | 5/1983 |
| KR | 20090092152 | A | 8/2009 |
| WO | 2008/066225 | A1 | 6/2008 |

* cited by examiner

LIGHTWEIGHT THREE-DIMENSIONAL WIRE STRUCTURE AND METHOD FOR THE PRODUCTION THEREOF

BACKGROUND OF THE INVENTION

Field of the Invention

The invention relates to a lightweight three-dimensional wire structure which consists of multiple wires, which are connected to each other and cross over in three-dimensional space so as to form a plurality of cells.

In addition, the invention relates to a method for the production of such a three-dimensional wire structure. The invention is used, for example, in medical engineering, vehicle construction, mechanical engineering and civil engineering.

Such a solution is known from DE 11 2004 002 127 T5 A1, this latter consisting of six groups of continuous wires, which are intercrossed at angles of 60 degrees or 120 degrees in a three-dimensional space, and a cell within the three-dimensional wire structure comprises:

a) a first regular tetrahedron member, formed from a first to sixth wire, wherein the first regular tetrahedron member is designed in such a manner that the first wire, the second wire and the third wire are intercrossed in one plane in order to form an equilateral triangle, the fourth wire is designed to be intercrossed with the intersection point of the second wire and the third wire, the fifth wire is intercrossed with the intersection point of the first wire and the second wire, and the sixth wire is intercrossed with the intersection point of the third wire and the first wire, the fourth wire, the fifth wire and the sixth wire being intercrossed with one another at a single intersection point;

b) a second regular tetrahedron member, which is connected to the first regular tetrahedron member at the intersection point and has a similar form to the first regular tetrahedron member, the second regular tetrahedron member being constructed in such a manner that the fourth wire, the fifth wire and the sixth wire pass through the intersection point and extend further, each of a group of wires being intercrossed with two wires that have been selected from the extended fourth, fifth and sixth wires, the group of wires being arranged parallel to the first wire, the second wire and/or the third wire; and c) wherein the wires are intercrossed with each other at 60 degrees or 120 degrees, and the cell is repeated in a three-dimensional pattern, as a result of which a frame-like three-dimensional structure is formed.

In this case, the wires of the intersection points are connected to each other by means of bonding, soldering or welding.

The disadvantage of this solution is to be seen in the fact that the wires extend in all directions (x, y and z) through the 3D structure and, on account of a lack of a self-supporting capacity, for the permanent stabilizing of the frame-like three-dimensional structure, initially have to be held in a defined fixed position and then have to be fixed to each other at the intersection points by means of additional connecting means. In addition, the longest of the required wires extend diagonally through the entire three-dimensional wire structure.

Consequently, a lot of time and money needs to be spent on construction, production engineering, instrument engineering and materials to produce the frame-like three-dimensional wire structure. In addition, the frame is characterized by a degree of rigidity in all directions which, for diverse applications, cannot be regarded as optimum.

BRIEF SUMMARY OF THE INVENTION

In the case of a generic three-dimensional wire structure, this object is achieved by the present invention.

The advantages of the invention are that a three-dimensional wire structure is made available, the wires of which are themselves provided as self-supporting such that there is no need for the use of additional connecting elements for the wires and consequently the cost of the materials and production can be reduced. For adapting to the respective application, the wire structure is characterized by direction-dependent elasticity characteristics or also by a high level of rigidity in all directions. By designing the three-dimensional wire structure in layers, where the length and the quantity of helical wires determines the extent of the layer in the x and y direction, the disadvantage of the wires passing diagonally through the entire wire structure as in the prior art is eliminated.

In addition, the necessary interaction, as claimed in the aforementioned prior art, between the wires in all directions within the three-dimensional wire structure is no longer necessary. In production engineering terms, the previous boundaries of producibility are extended as the extension in the z direction is now theoretically infinite.

The invention is to be explained below by way of an exemplary embodiment and associated drawings, in which, in detail:

DESCRIPTION OF THE INVENTION

Figure 1:
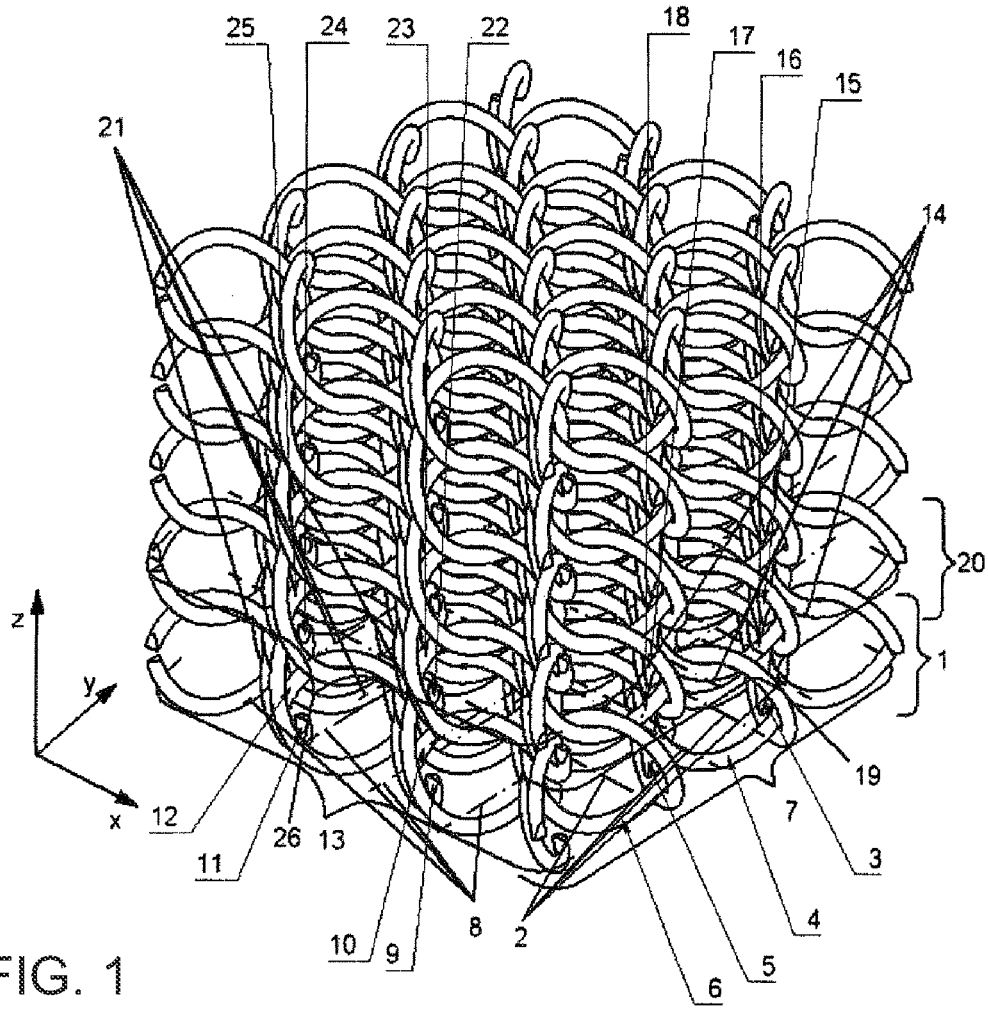
FIG. 1 shows a perspective view of the lightweight three-dimensional wire structure according to the invention.

FIG. 1 shows the lightweight three-dimensional wire structure. This latter consists of a plurality of helically wound wires 3, 4, 5, 6, 9, 10, 11, 12, 15, 16, 17, 18, 22, 23, 24, 25, which are connected to each other crossing over in three-dimensional space so as to form cells and are arranged with changing alignment of their axes 2, 8, 14, 21 and in different planes 1, 20. A wire structure, which is assembled from two planes 1, 20 and is able to be extended by further planes in an arbitrary manner in the z direction, is reproduced as an example. In this case, the plane 1 is formed from the woven wire meshes 7, 13 and the plane 20 from the woven wire meshes 19, 26.

Figure 2:
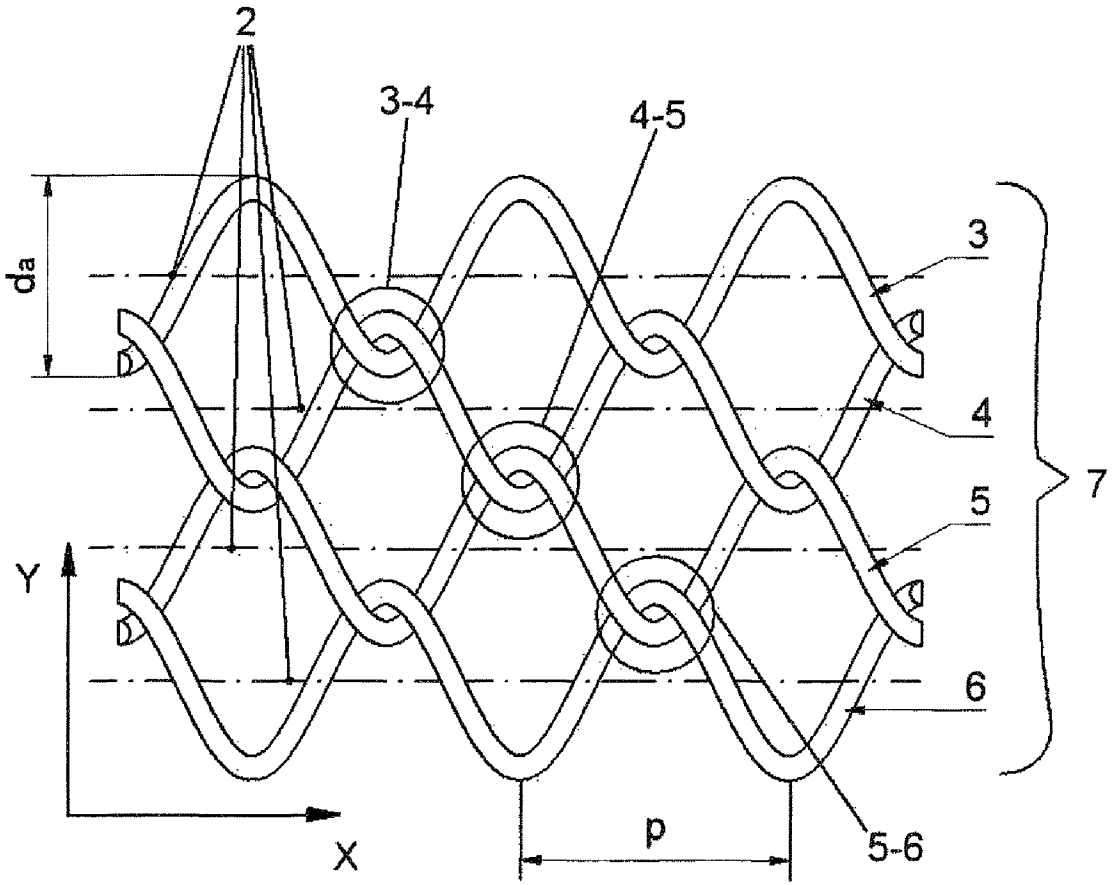
FIG. 2 shows a top view of the first wire mesh of the first plane.

The design of such a wire structure is as follows:

In FIG. 2, in a first plane 1, multiple, for example four, helical first wires 3, 4, 5, 6, which extend parallel to each other by way of their axes 2, by crossing over at their respective intersection points 3-4, 4-5, 5-6, are developed to form a first wire mesh 7, which is connected in the x and y direction and where two adjacent wires are connected by means of one intersection point per winding. The distance between the axes 2 of two adjacent first wires 3, 4, 5, 6 is half of the pitch p of the wires. By incorporating further first wires, the wire mesh 7 is arbitrarily extendible in the y direction. The length of the wires used in this case is produced from the extension in the x direction.

Figure 3:
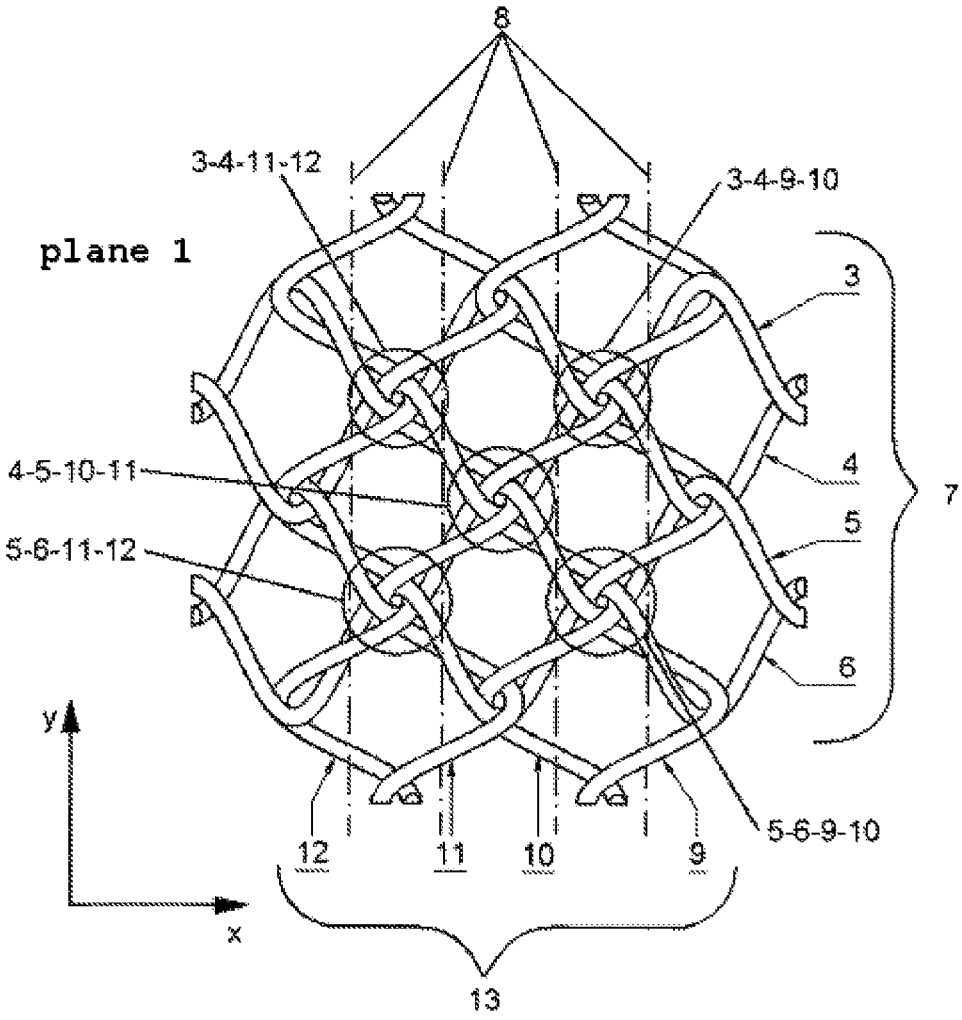
FIG. 3 shows a top view of the first wire mesh of the first plane as in FIG. 2 passed through transversely by the second wire mesh of the first plane.

With reference to FIG. 3, on the first wire mesh 7, multiple, for example four, helical second wires 9, 10, 11, 12, which extend parallel to each other by way of their axes 8, are additionally provided transversely in relation to the axes 2 of the first wires 3, 4, 5, 6, said second wires, to form a second wire mesh 13 within the first plane 1, intersect at their intersection points 9-10, 10-11, 11-12 both with each other and with the intersection points 3-4, 4-5, 5-6 of the wires 3, 4, 5, 6 of the first wire mesh 7 at intersection points, for example 3-4-9-10, 3-4-11-12, 4-5-10-11, 5-6-9-10, 5-6-11-12. For a complete cell, in each case four wires must be in contact at four intersection points which are arranged in a rectangle and, in this manner, in each case, form an intersection point that is equal in terms of said structure.

To simplify the representation, only the intersection points 3-4-9-10, 3-4-11-12, 4-5-10-11, 5-6-9-10, 5-6-1-12 are represented as equal intersection points in FIG. 3.

The plane 1, produced in such a manner, consequently consists of the interconnected wire meshes 7 and 13. The second wire mesh 13 is created by the individual incorporation of the second wires 9, 10, 11, 12 into the first wire mesh 7 consisting of the first wires 3, 4, 5, 6. The plane 1 is extendible in an arbitrary manner in the x and y direction.

Figure 4:
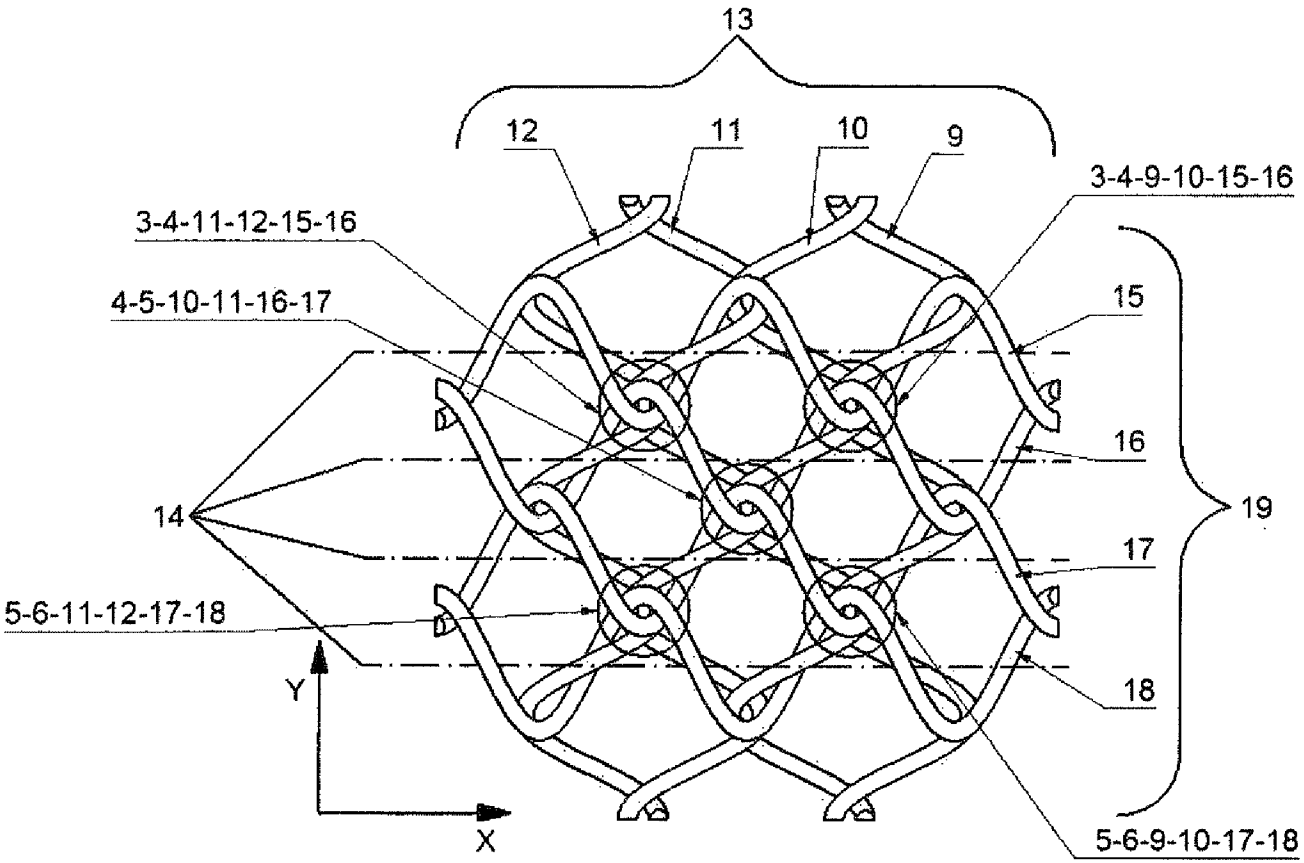
FIG. 4 shows a top view of the wire meshes of the first plane as in FIG. 3 passed through by the first wire mesh of the second plane.
Figure 5:
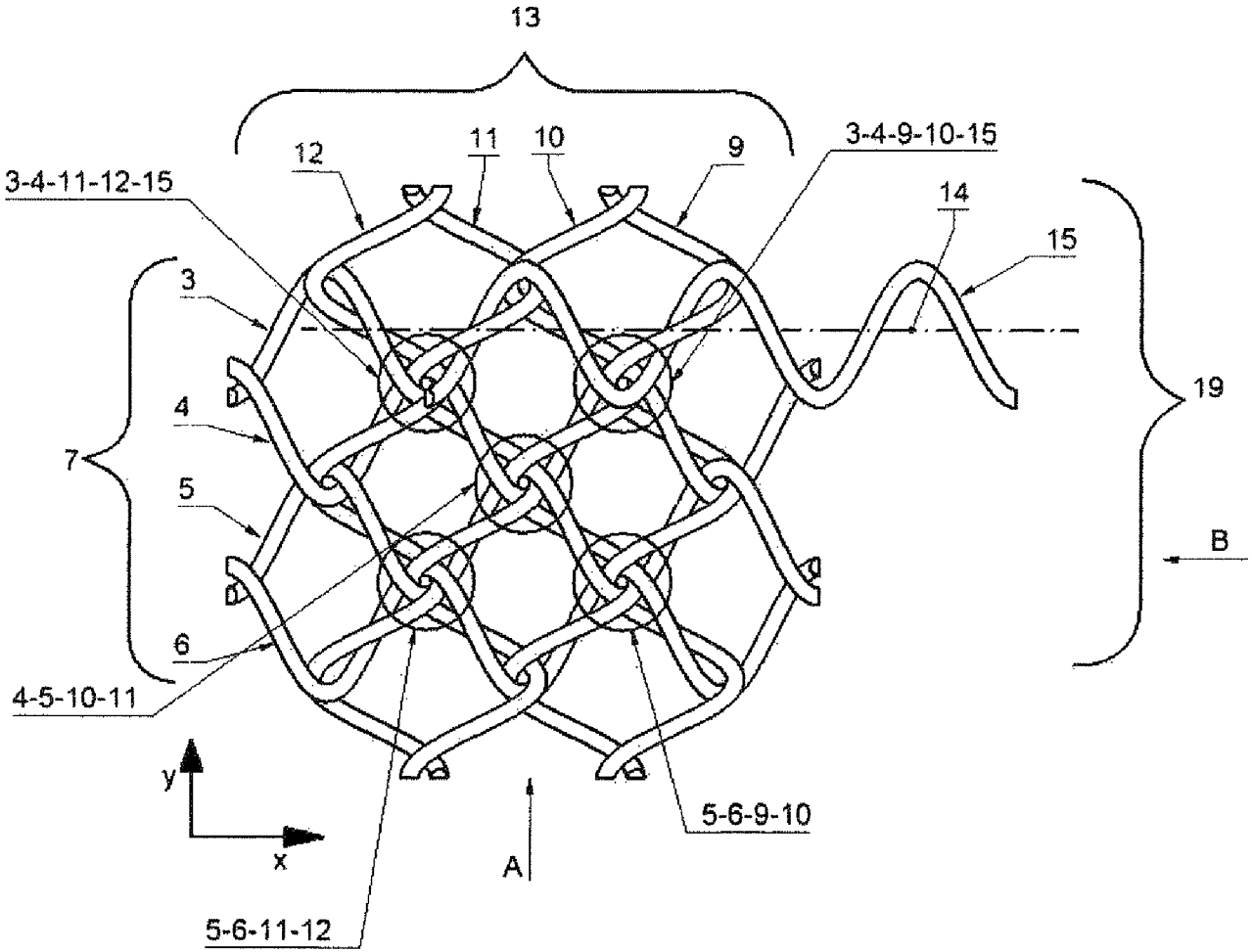
FIG. 5 shows a top view of the wire meshes of the first plane as in FIG. 3 passed through by the first wire of the first mesh of the second plane.
Figure 6:
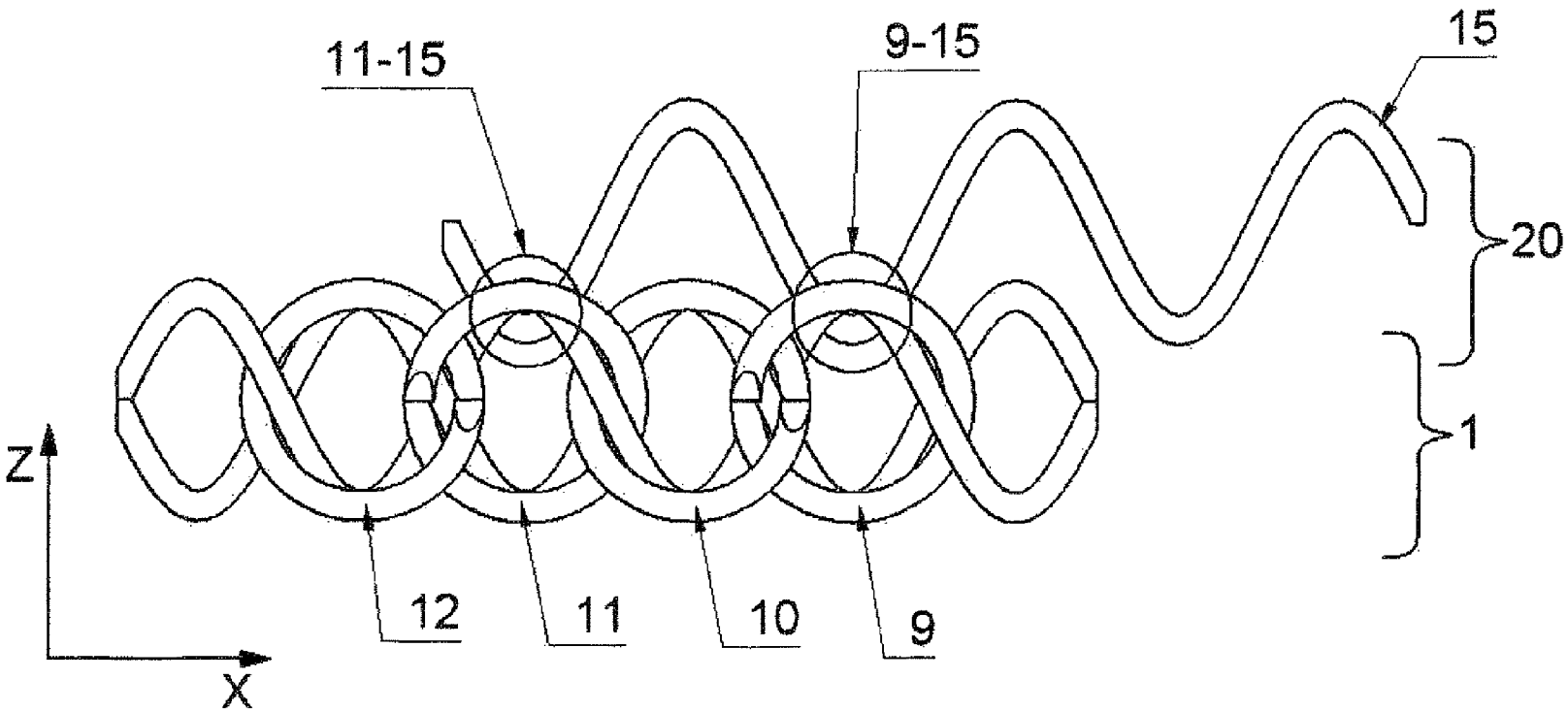
FIG. 6 shows a side view in the direction of the arrow A in FIG. 5.
Figure 7:
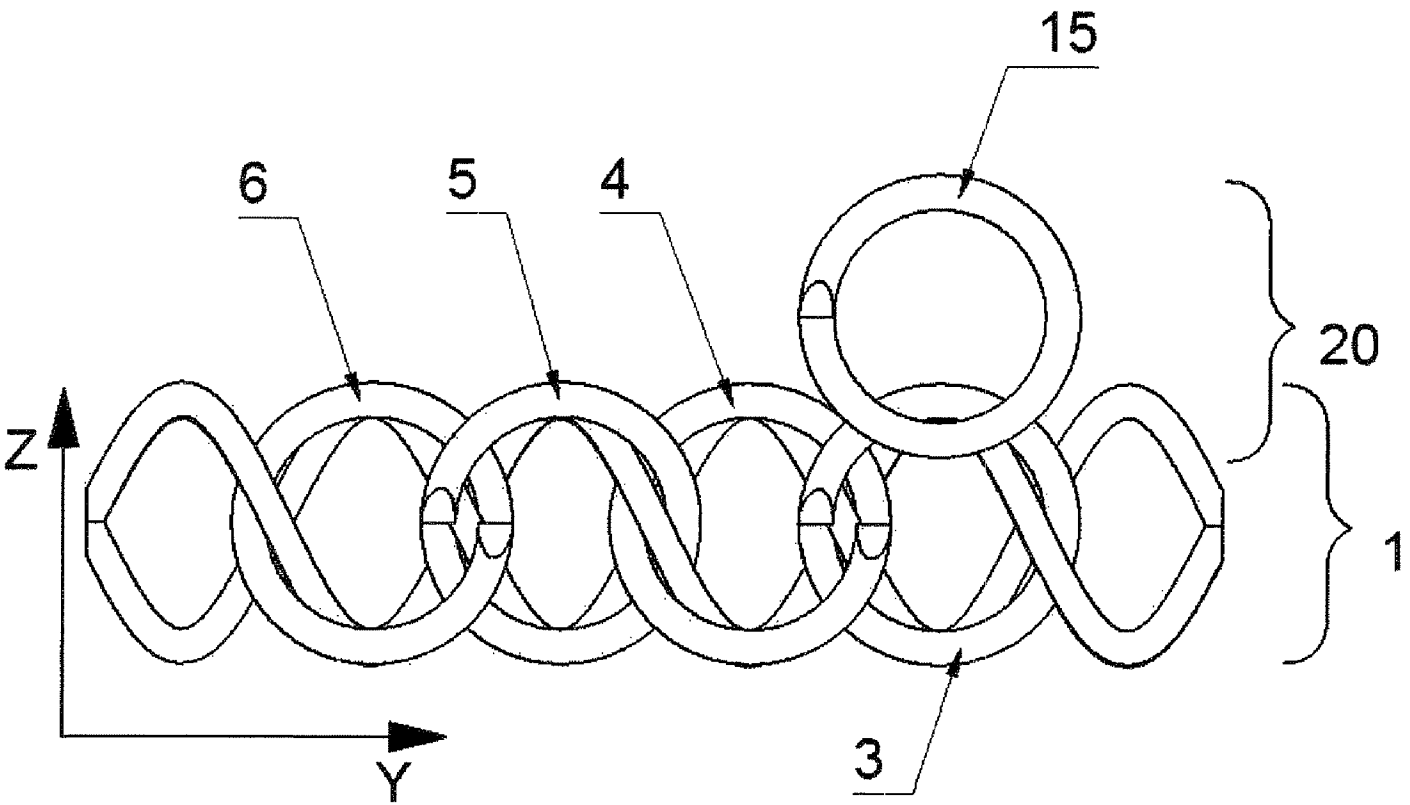
FIG. 7 shows a front view in the direction of the arrow B in FIG. 5.
Figure 8:
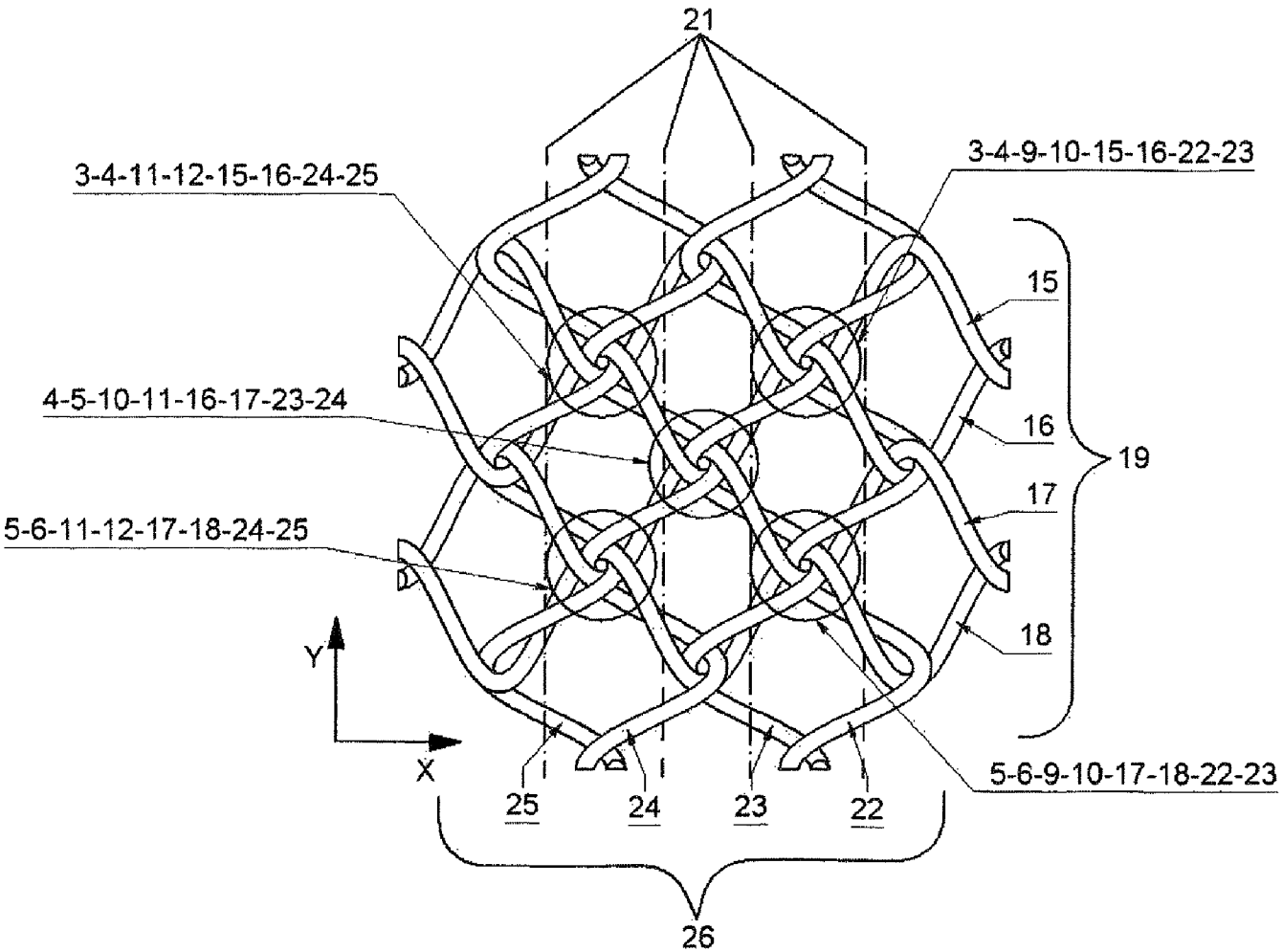
FIG. 8 shows a top view of the first wire mesh of the second plane passed through by the second wire mesh of the second plane.
Figure 9:
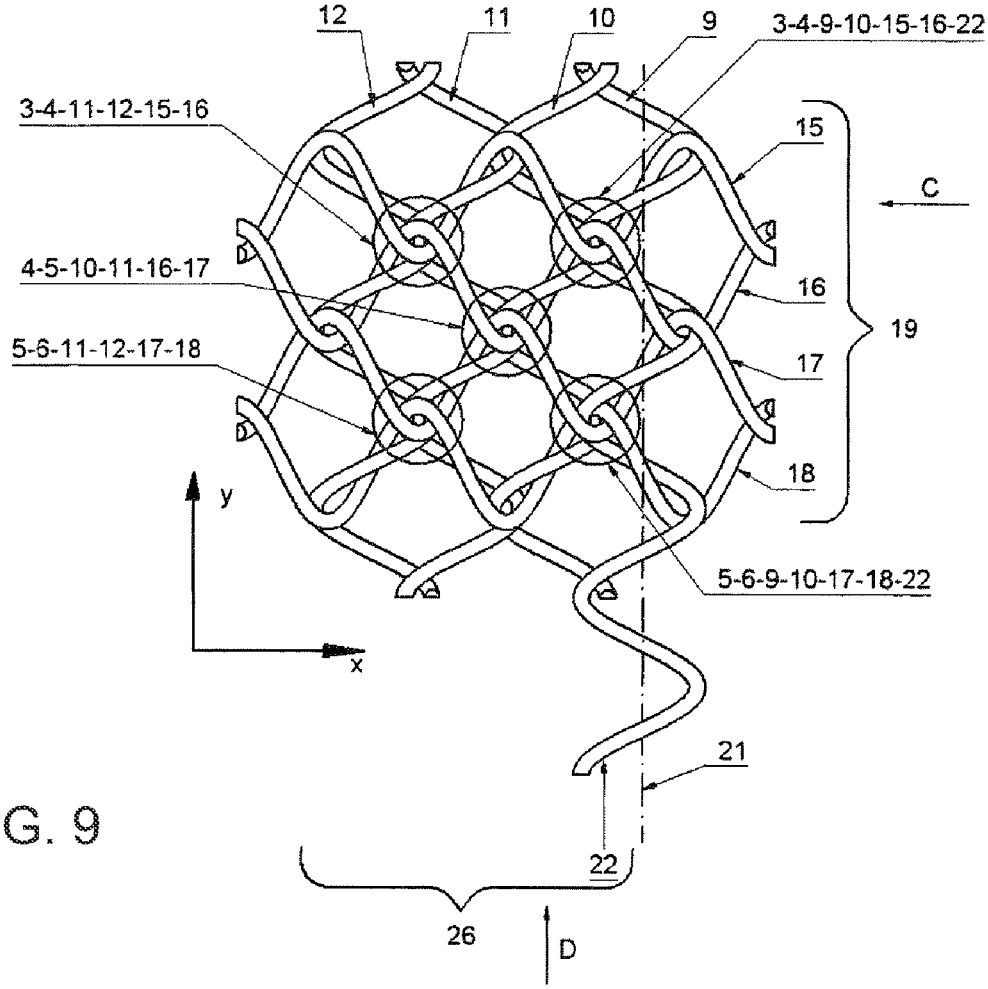
FIG. 9 shows a top view of the wire meshes of the first plane as in FIG. 3 passed through by the first wire of the second mesh of the second plane.
Figure 10:
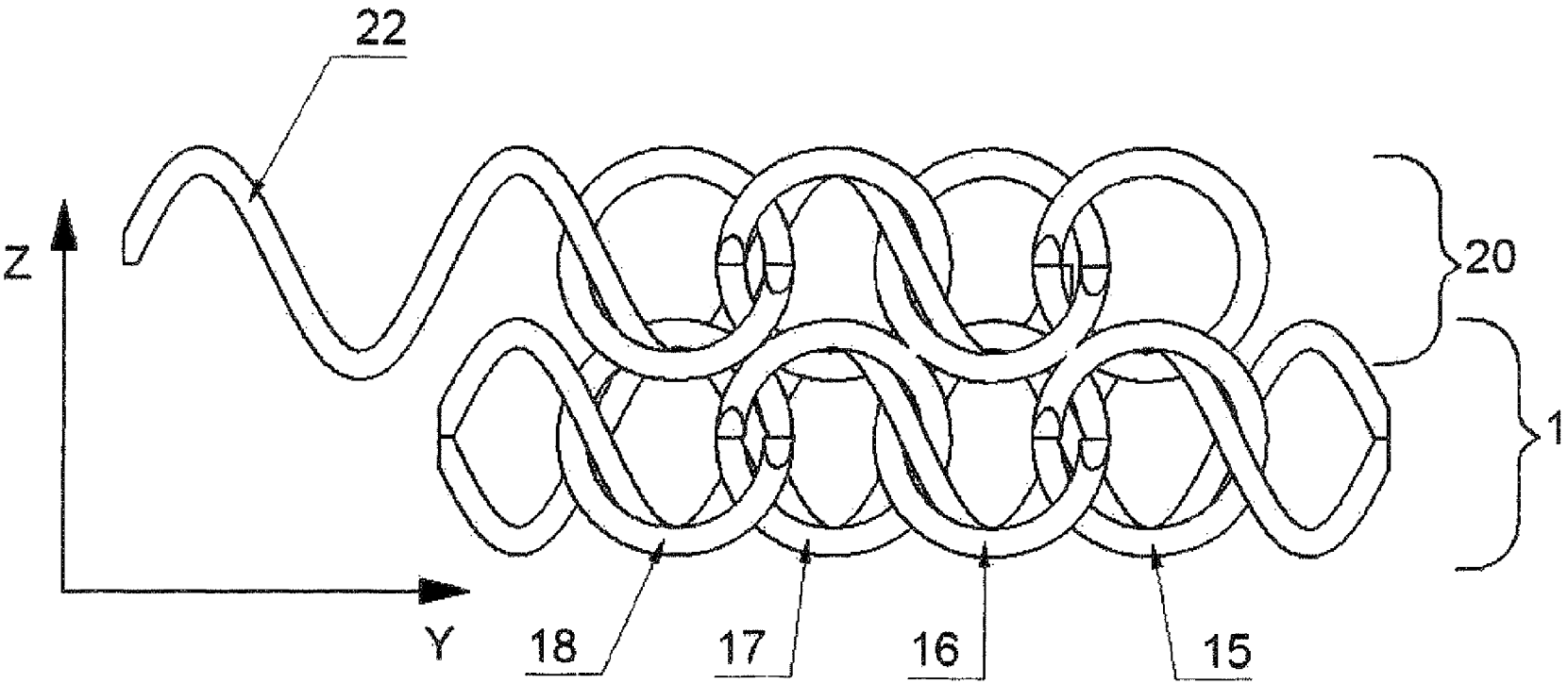
FIG. 10 shows a side view in the direction of the arrow C in FIG. 9.
Figure 11:
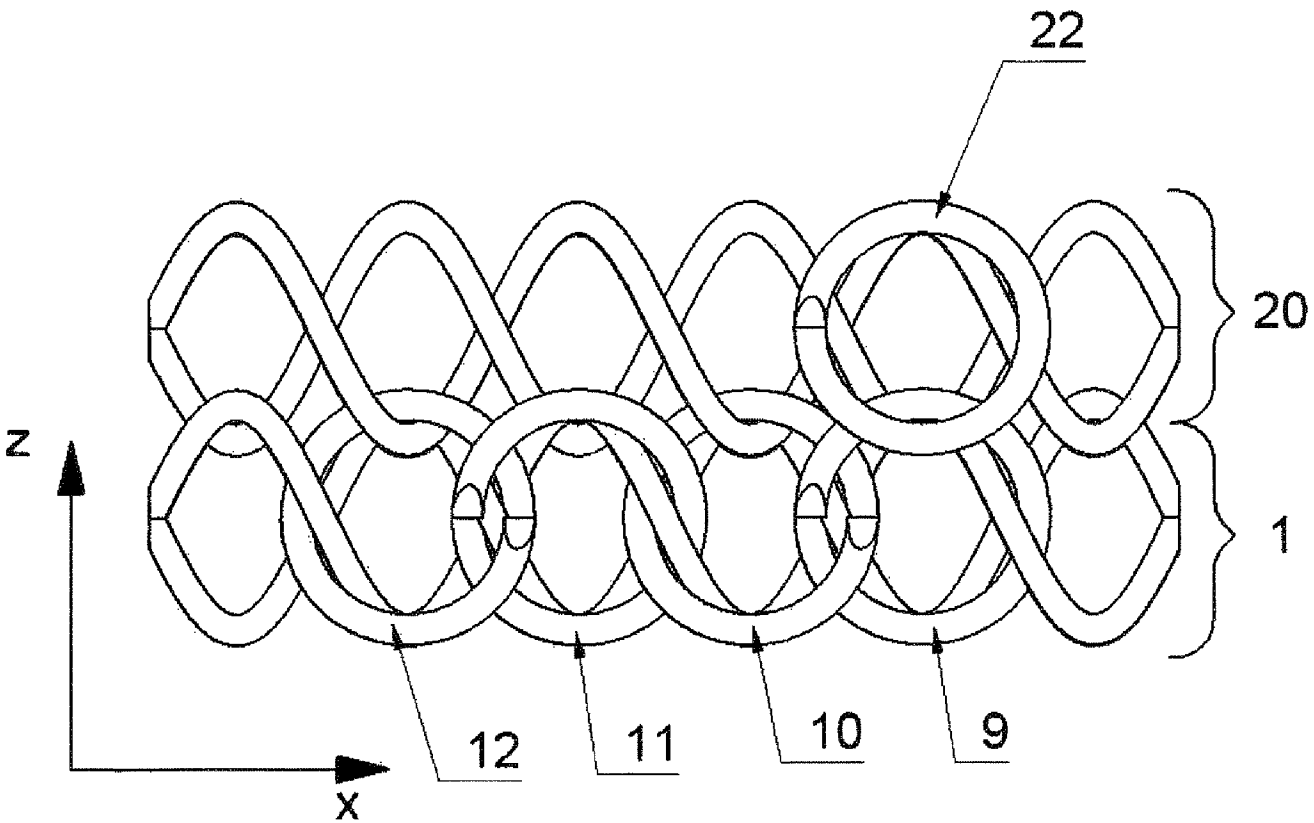
FIG. 11 shows a side view in the direction of the arrow D in FIG. 9.

It can be seen from FIGS. 4 to 7 that, displaced in the z direction in relation to the connected wire meshes 7, 13 of the first plane 1, are provided helical third wires 15, 16, 17, 18, which once again extend parallel to each other by way of their axes 14, for forming a first wire mesh 19 extending in the y direction within the second plane 20, said third wires cross over each other and with the second wires 9, 10, 11, 12 of the first plane 1 offset transversely thereto in such a manner that each second one of the second wires 9, 10, 11, 12 of the first plane 1 is crossed over. At the same time, the third wires 15, 16, 17, 18 are displaced in the z direction in relation to the parallel extending first wires 3, 4, 5, 6 by $$\sqrt{d_a^2 - \left(\frac{p}{2}\right)^2}$$

wherein $d_a$ represents the external diameter and p the pitch of the helical wires (see FIG. 2). The helical third wires 15, 16, 17, 18 of the first wire mesh of the second plane 20 meet the helical wires 3, 4, 5, 6, 9, 10, 11, 12 of the first plane 1 at the intersection points 3-4-11-12-15-16, 3-4-9-10-15-16, 4-5-10-11-16-17, 5-6-11-12-17-18 and 5-6-9-10-17-18 (FIG. 4).

Finally, FIGS. 8 to 11 show that multiple, for example four, helical fourth wires 22, 23, 24, 25, which extend parallel to each other by way of their axes 21, are provided transversely to the axes 14 of the third wires 15, 16, 17, 18 and parallel to the wires 9, 10, 11, 12 of the first plane 1, said fourth wires 22, 23, 24, 25, to form a second wire mesh 26 within the second plane 20, intersect at their intersection points 22-23, 23-24, 24-25 both with each other and with the intersection points 15-16, 16-17, 17-18 of the wires 15, 16, 17, 18 of the second wire mesh 19 within the second plane 20 to form intersection points 15-16-22-23, 15-16-24-25, 16-17-23-24, 17-18-22-23, 17-18-24-25.

The wire mesh 26 in the x direction is then connected to the wire mesh 19 in the y direction of the plane 20 so as to coincide with the wire meshes 7, 13 of the plane 1. The wire meshes 19 and 26 are connected to the plane 1 by means of the intersection points 3-4-11-12-15-16-24-25, 3-4-9-10-15-16-22-23, 4-5-10-11-16-17-23-24, 5-6-9-10-17-18-22-23, 5-6-11-12-17-18-24-25 of the individual wires 3, 4, 5, 6, 9, 10, 11, 12, 15, 16, 17, 18, 22, 23, 24, 25. Further intersection points are created if the next plane, as shown above, is constructed on the existing plane 20.

Further plane construction in the z direction is effected in an analogous manner to the above description such that the extension of the 3-dimensional wire structure in the z direction theoretically has no boundaries.

The first to fourth wires can be produced from the most varied materials, for example metallic or non metallic materials.

In addition, it is possible for the first to fourth wires 3, 4, 5, 6, 9, 10, 11, 12, 15, 16, 17, 18, 22, 23, 24, 25 of the individual planes 1, 20 to have identical or different geometric forms, for example round, triangular, rectangular or polygonal cross sections. The wires 3, 4, 5, 6, 9, 10, 11, 12, 15, 16, 17, 18, 22, 23, 24, 25 can be produced from solid or hollow material.

To produce direction-dependent elasticity characteristics for the three-dimensional wire structure, it is possible to use wires produced from different materials within one and/or several of the planes 1, 20.

The elasticity characteristics can also be influenced by, in part, wires of different lengths being arranged in one and/or several of the planes 1, 20. The elasticity characteristics can also be determined by the geometric characteristics pitch p, wire diameter and external diameter of the helical wires 3, 4, 5, 6, 9, 10, 11, 12, 15, 16, 17, 18, 22, 23, 24, 25 by, with various parameters such as pitch p and/or wire diameter, the wires 3, 4, 5, 6, 9, 10, 11, 12, 15, 16, 17, 18, 22, 23, 24, 25 being tensioned stronger or slacker in individual planes or directions.

If further wires 3', 4', 5', 6', 9', 10', 11', 12', 15', 16', 17', 18', 22', 23', 24', 25' and/or 3", 4", 5", 6", 9", 10", 11", 12", 15", 16", 17", 18", 22", 23", 24', 25" are arranged in the x and y direction in the planes 1, 20 in an analogous manner in the three-dimensional wire structure developed as described above, it is possible to form one or multiple separate three-dimensional wire structures within the wire structure in FIG.

Figure 12:
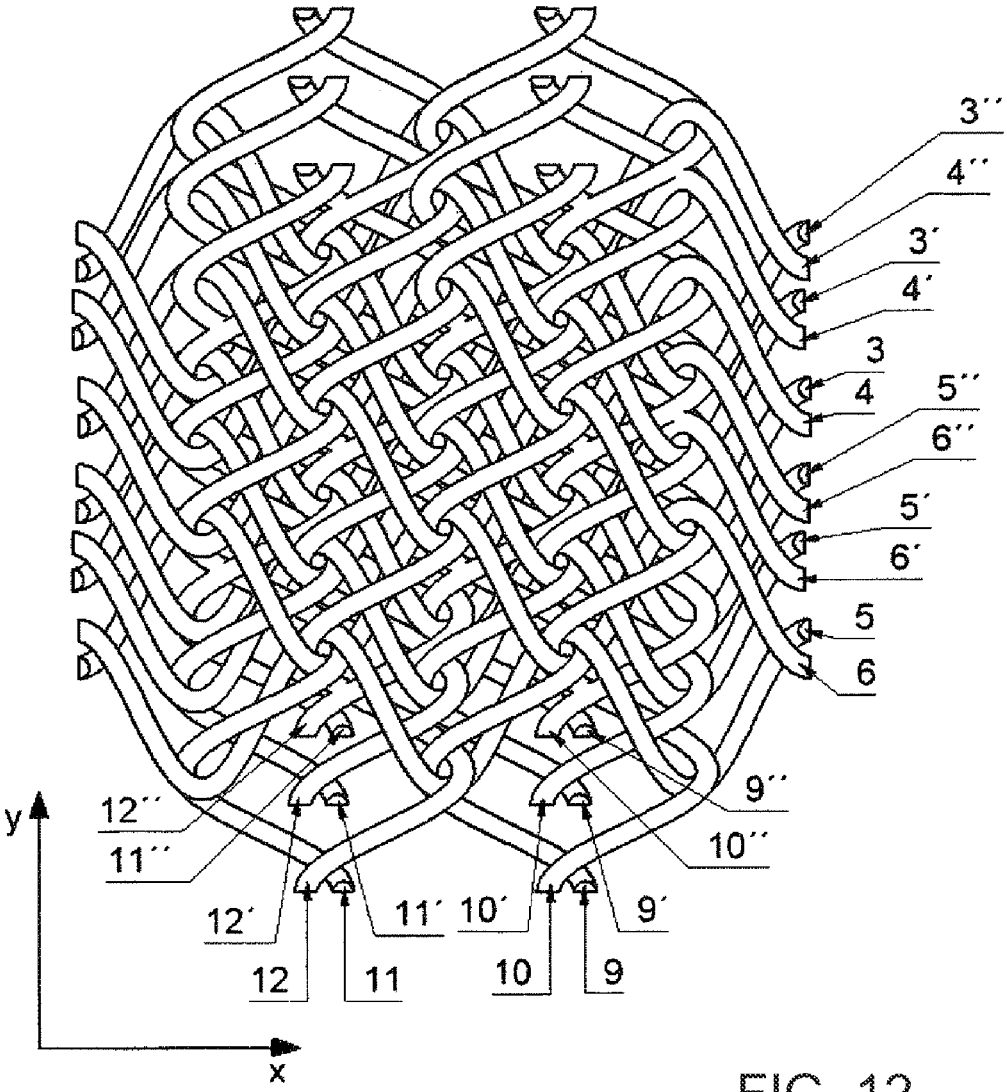
FIG. 12 shows a top view of the wire meshes of the first plane as in FIG. 3 passed through by a second and third wire structure.
Figure 13:
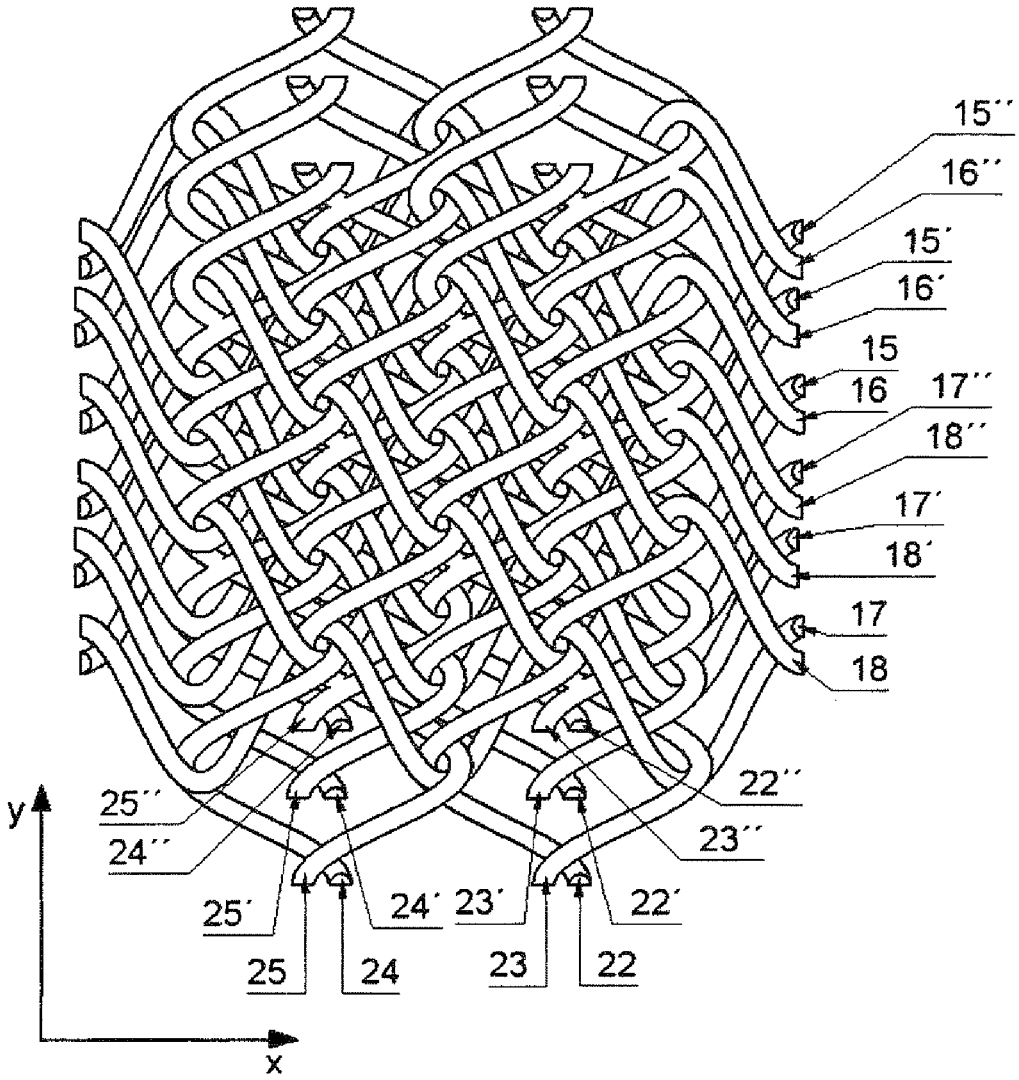
FIG. 13 shows a top view of the wire meshes of the second plane as in FIG. 8 passed through by a second and third wire structure.

1, said wire structures being arranged within the (first) wire structure so as to be moveable as in FIG. 1 or fixed in dependence on their number. FIG. 12 shows as an example a second and third wire structure formed within the first plane 1 from the wires 3', 4', 5', 6', 9', 10', 11', 12' and 3", 4", 5", 6", 9", 10", 11", 12". FIG. 13 shows as an example a second and third wire structure within the second plane 20 formed from the wires 15', 16', 17', 18', 22', 23', 24', 25' and 15", 16", 17", 18", 22", 23", 24", 25".

To develop a less elastic to rigid three-dimensional wire structure, the wires 3, 4, 5, 6, 9, 10, 11, 12, 15, 16, 17, 18, 22, 23, 24, 25 can be connected to each other using bonding technology at one or several of their intersection points 3-4-11-12-15-16-24-25, 3-4-9-10-15-16-22-23, 4-5-10-11-16-17-23-24, 5-6-9-10-17-18-22-23, 5-6-11-12-17-18-24-25.

The method for the production of the three-dimensional wire structure as claimed in the invention is characterized in that for forming a first plane 1 from two wire meshes 7, 13 helically wound first wires 3, 4, 5, 6, which extend parallel to each other by way of their axes 2, are twisted into each other in the x direction such that two adjacent wires are connected via an intersection point 3-4, 4-5, 5-6 per winding, transversely in relation to the axes 2 of the first wires 3, 4, 5, 6, multiple helical second wires 9, 10, 11, 12, which extend parallel to each other by way of their axes 8, are twisted into the first wire mesh 7 of the first wires 3, 4, 5, 6, and for forming a second plane 20 from two wire meshes 19, 26, after displacement carried out in the z direction in relation to the first plane 1 of the aforementioned wire meshes 7, 13, multiple helical third wires 15, 16, 17, 18, which extend parallel to each other by way of their axes 14, crossing over each other and also the second wires 9, 10, 11, 12 of the first plane 1 offset transversely thereto, are twisted in such that each second one of the second wires 9, 10, 11, 12 of the first plane 1 is crossed over and, at the same time, the first wire mesh 19 is formed within the second plane 20 as well as transversely in relation to the axes 14 of the third wires 15, 16, 17, 18, multiple helical fourth wires 22, 23, 24, 25, which extend parallel to each other by way of their axes 21, are twisted in, said fourth wires 22, 23, 24, 25, to form the second wire mesh 26 within the second plane 20, intersect at their intersection points 22-23, 23-24, 24-25 both with each other and with the intersection points 15-16, 16-17, 17-18 of the third wires 15, 16, 17, 18 of the first wire mesh 19 of the second plane 20 to form an intersection point 15-16-22-23, 15-16-24-25, 16-17-23-24, 17-18-22-23, 17-18-24-25.

In addition, it is possible for further wires 3', 4', 5', 6', 9', 10', 11', 12', 15', 16', 17', 18', 22', 23', 24', 25' and/or 3", 4", 5", 6", 9", 10", 11", 12", 15", 16", 17", 18", 22", 23", 24", 25" to be twisted into the planes 1, 20 in the x and y direction in an analogous manner in the three-dimensional wire structure produced as described above (see FIGS. 12 and 13).

Finally the wires 3, 4, 5, 6, 9, 10, 11, 12, 15, 16, 17, 18, 22, 23, 24, 25; 3', 4', 5', 6', 9', 10', 11', 12', 15', 16', 17', 18', 22', 23', 24', 25' and/or 3", 4", 5", 6", 9", 10", 11", 12", 15", 16", 17", 18", 22", 23", 24", 25" can be connected using bonding technology at one or several of their intersection points 3-4-11-12-15-16-24-25, 3-4-9-10-15-16-22-23, 4-5-10-11-16-17-23-24, 5-6-9-10-17-18-22-23, 5-6-11-12-17-18-24-25; 3'-4'-11'-12'-15'-16'-24'-25', 3'-4'-9'-10'-15'-16'-22'-23', 4'-5'-10'-11'-16'-17'-23'-24', 5'-6'-9'-10'-17'-18'-22'-23', 5'-6'-11'-12'-17'-18'-24'-25'; 3"-4"-11"-12"-15"-16"-24"-25", 3"-4"-9"-10"-15"-16"-22"-23", 4"-5"-10"-11"-16"-17"-23"-24", 5"-6"-9"-10"-17"-18"-22"-23", 5"-6"-11"-12"-17"-18"-24"-25" such that a less elastic to rigid three-dimensional wire structure is created.

LIST OF REFERENCES

| | |
|---|---|
| 1 | first plane |
| 2 | axis of 3 to 6 |
| 3 | first wire |
| 4 | first wire |
| 5 | first wire |
| 6 | first wire |
| 7 | first wire mesh within the plane 1 |
| 8 | axis of 9 to 12 |
| 9 | second wire |
| 10 | second wire |
| 11 | second wire |
| 12 | second wire |
| 13 | second wire mesh within the plane 1 |
| 14 | axis of 15 to 18 |
| 15 | third wire |
| 16 | third wire |
| 17 | third wire |
| 18 | third wire |
| 19 | first wire mesh within the plane 20 |
| 20 | second plane |
| 21 | axis of 22 to 25 |
| 22 | fourth wire |
| 23 | fourth wire |
| 24 | fourth wire |
| 25 | fourth wire |
| 26 | second wire mesh within the plane 20 |
| 3-4 | intersection point |
| 4-5 | intersection point |
| 5-6 | intersection point |
| 9-10 | intersection point |
| 10-11 | intersection point |
| 11-12 | intersection point |
| 9-15 | intersection point |
| 11-15 | intersection point |
| 3-4-9-10 | intersection point |
| 3-4-11-12 | intersection point |
| 4-5-10-11 | intersection point |
| 5-6-9-10 | intersection point |
| 5-6-11-12 | intersection point |
| 15-16-22-23 | intersection point |
| 15-16-24-25 | intersection point |
| 16-17-23-24 | intersection point |
| 17-18-22-23 | intersection point |
| 17-18-24-25 | intersection point |
| 3-4-9-10-15 | intersection point |
| 3-4-11-12-15 | intersection point |
| 3-4-11-12-15-16 | intersection point |
| 4-5-10-11-16-17 | intersection point |
| 5-6-11-12-17-18 | intersection point |
| 3-4-9-10-15-16-22 | intersection point |
| 5-6-9-10-17-18-22 | intersection point |
| 3-4-11-12-15-16-24-25 | intersection point |
| 3-4-9-10-15-16-22-23 | intersection point |
| 4-5-10-11-16-17-23-24 | intersection point |
| 5-6-9-10-17-18-22-23 | intersection point |
| 5-6-11-12-17-18-24-25 | intersection point |
| 3'-4'-11'-12'-15'-16'-24'-25' | intersection point |
| 3'-4'-9'-10'-15'-16'-22'-23' | intersection point |
| 4'-5'-10'-11'-16'-17'-23'-24' | intersection point |
| 5'-6'-9'-10'-17'-18'-22'-23' | intersection point |
| 5'-6'-11'-12'-17'-18'-24'-25' | intersection point |
| 3"-4"-11"-12"-15"-16"-24"-25" | intersection point |
| 3"-4"-9"-10"-15"-16"-22"-23" | intersection point |
| 4"-5"-10"-11"-16"-17"-23"-24" | intersection point |
| 5"-6"-9"-10"-17"-18"-22"-23" | intersection point |
| 5"-6"-11"-12"-17"-18"-24"-25" | intersection point |
| da | external diameter |
| p | pitch |

The invention claimed is:

1. A lightweight three-dimensional wire structure, having multiple wires which are connected to each other and cross over in three-dimensional space for defining a plurality of cells, the wire structure comprising:

helically wound wires;

multiple helical first wires having first wire axes, said first wires being disposed in a plane with said first wire axes parallel to one another, said first wires crossing over at intersection points for defining a first wire mesh being connected in an x and y direction, two adjacent said first wires being connected by one intersection point per winding;

multiple helical second wires, having second wire axes, said second wire axes being parallel to one another and disposed transversely in relation to said first wire axes, said second wires defining a second wire mesh within said plane, said second wires intersecting with one another and with said first wires of the first wire mesh at said intersection points;

multiple helical third wires having third wire axes, said third wire axes being parallel to one another, said third wires being displaced in a z direction in relation to said plane, said third wires crossing over one another and said third wires crossing over said first and second wires such that that each second one of the second wires is crossed over; and multiple helical fourth wires having fourth wire axes, said fourth wire axes being parallel to one another and being provided transversely to said third wire axes, said fourth wires defining a second wire mesh within a second plane, said fourth wires intersecting with one another at said intersection points and said fourth wires intersecting with said intersection points.

2. The lightweight three-dimensional wire structure according to claim 1, wherein said wires are produced from metallic or non metallic materials.

3. The lightweight three-dimensional wire structure according to claim 1, wherein said wires, which are produced from different materials, are provided within one and/or several of the planes.

4. The lightweight three-dimensional wire structure according to claim 1, wherein said wires of individual ones of said planes have an identical or different geometric form.

5. The lightweight three-dimensional wire structure according to claim 4, wherein the geometric form of the wires is realized as a round, triangular, rectangular or polygonal cross section.

6. The lightweight three-dimensional wire structure according to claim 1, wherein said wires are produced from a solid or hollow material.

7. The lightweight three-dimensional wire structure according to claim 1, wherein, in part, wires of different lengths are arranged in one and/or several of said planes.

8. The lightweight three-dimensional wire structure according to claim 1, wherein further wires are arranged in the x and y direction in one and/or several of said planes.

9. The lightweight three-dimensional wire structure according to claim 1, wherein said wires are connected to each other using bonding technology at one or several of said intersection points.

10. A method for the production of a lightweight three-dimensional wire structure, comprising:

twisting helically wound first wires having axes extending parallel to one another, by twisting the first wires into one another in an x direction such that two adjacent wires are connected via an intersection point per winding for defining a first plane;

transversely in relation to the axes of the first wires, twisting multiple helical second wires, having second axes extending parallel to one another, by twisting into a first wire mesh of the first wires twisting multiple helical third wires, displaced in a z direction in relation to the plane and having third axes extending parallel to to one another, the third wires crossing over one another and also crossing over the second wires for defining a second plane, the third wires being twisted such that each second one of the second wires is crossed over and, at the same time, a first second plane wire mesh is formed within the second plane;

twisting multiple helical fourth wires having fourth axes extending parallel to one another, the fourth wires defining a second wire mesh within the second plane, the fourth wires intersecting with one another at the intersection points and the fourth wires intersecting with the intersection points.

11. The method according to claim 10, wherein further wires are twisted into the planes in the x and y direction.

12. The method according to claim 10, wherein the wires are connected using bonding technology at one or several of the intersection points.

* * * * *